US005946752A

United States Patent [19]

Parrish

[11] Patent Number: 5,946,752

[45] **Date of Patent: *Sep. 7, 1999**

[54] SPRING BIASED IMPLEMENT FOR USE IN MULTI-FUNCTION TOOLS

[75] Inventor: Bradford J. Parrish, Oregon City, Oreg.

[73] Assignee: Fiskars Inc., Madison, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,030

[22] Filed: Jan. 15, 1997

[51] Int. Cl.[6] ..... B26B 11/00

[52] U.S. Cl. ..... 7/118; 7/128; 30/261

[58] Field of Search ..... 7/118, 125, 127, 7/128, 129, 132, 167, 168; 30/254, 255, 261, 146

[56] References Cited

U.S. PATENT DOCUMENTS

| | | | |
|---|---|---|---|
| 79,191 | 6/1868 | Bergner . | |
| 310,439 | 1/1885 | Kamak . | |
| 515,828 | 3/1894 | Hayden | 7/118 |
| 1,467,661 | 9/1923 | Undy | 7/118 |
| 1,828,121 | 10/1931 | Adam et al. | 7/118 |
| 2,392,118 | 1/1946 | Cacarillo | 30/261 |
| 2,512,862 | 6/1950 | Ingwer . | |
| 2,524,653 | 10/1950 | Dalley . | |
| 2,729,996 | 1/1956 | Schoenwald . | |
| 3,834,022 | 9/1974 | Students . | |
| 4,203,208 | 5/1980 | Tausen-freundt et al. . | |
| 5,142,721 | 9/1992 | Sessions et al. | 7/128 |
| 5,168,629 | 12/1992 | Willard . | |
| 5,400,451 | 3/1995 | Furukawa . | |

FOREIGN PATENT DOCUMENTS

| | | |
|---|---|---|
| 0676261A1 | 3/1995 | European Pat. Off. . |
| 0714736A1 | 6/1996 | European Pat. Off. . |
| 0771622A1 | 5/1997 | European Pat. Off. . |
| 227932 | 1/1925 | United Kingdom . |
| WO 97/19787 | 6/1997 | WIPO . |

OTHER PUBLICATIONS

The Nature Company Holiday 1996 Catalog, p. 24.

Three photographs: One of Victorinox Swiss Army Knife; One of Wenger Swiss Army Knife and One of Leatherman Multi–Purpose Tool PSII.

*Primary Examiner*—David A. Scherbel
*Assistant Examiner*—Joni B. Danganan
*Attorney, Agent, or Firm*—Foley & Lardner

[57] ABSTRACT

A multi-function tool includes a spring biased implement which can be stored within the handle of the multi-function tool when not in use. The implement includes first and second members pivotally attached at a pivot. The implement further includes a spring rotatably attached to an axle extending across a channel-shaped handle of the multi-function tool. The spring includes a first end attached to the first member of the implement and an arm which biases the second member away from the first member to an open working position.

25 Claims, 2 Drawing Sheets

SPRING BIASED IMPLEMENT FOR USE IN MULTI-FUNCTION TOOLS

FIELD OF THE INVENTION

This invention relates to a pocket tool including a spring biased implement. More particularly the present invention relates to a multi-function tool which includes a spring biased pair of scissors which can be stored within the handle of the multi-function tool when the scissors are not in use.

BACKGROUND OF THE INVENTION

In general, multi-function tools include in a pair of cooperable jaws such as plier jaws, and a variety of tools such as screwdrivers, knife blades and files. Multi-function tools may also include a pair of scissors or other pivoted implement (which will hereinafter be referred to generally as "scissors"). Scissors included in multi-function tools typically do not have handle loops configured to receive a human finger to facilitate the operation of the scissor blades. As a result, scissors included in multi-function tools include a spring to bias the blades to the open position. In the open position the cutting surfaces of the blades form an acute angle, such that an item to be cut may be placed between the cutting surfaces.

When not in use, the scissors are typically stored within the handle of the multi-function tool. Conversely, the scissors can be rotated about an axle or pivot out of the handle to an extended or working position. Therefore the spring arrangement must allow for the rotation of the scissors from the extended position to a stored or retracted position within the handle.

Prior art multi-function tools have used two basic spring arrangements to facilitate the biasing of the scissor blades. The first type of arrangement utilizes a spring located in the handle portion of the multi-function tool. The spring biases a fulcrum which in turn biases a working blade relative to a second blade. The spring/fulcrum arrangement is exemplified in the LEATHERMAN MULTI-PURPOSE TOOL PSII® and the WENGER SWISS ARMY KNIFE®, photographs of which have been filed herewith. The spring/fulcrum arrangement requires both the use of a spring located in the handle portion of the multi-function tool as well as a fulcrum member resulting in additional material cost.

The second type of arrangement utilizes a separate spring element attached to the scissors. In this arrangement a portion of the spring itself biases the handles of the scissors to an open position without the use of a fulcrum member. The open position is defined by the cutting surfaces of the scissor blades being at an acute angle. Several spring types may be used in this second arrangement.

One spring type, which is exemplified in the VICTORINOX® Swiss Army Knife, utilizes a flat leaf spring having a first end attached to a first scissor handle distal the blade tip and a second end which biases the second scissor handle. This flat spring is positioned between the handles intermediate the blade pivot and the multi-function tool handle. This type of spring is subject to becoming dislodged (thus no longer performing its function), damaged or lost.

Additionally, in this flat spring type, the distance between the multi-function tool handle and the blade pivot must be sufficient to receive the spring. This requires the blade pivot to be further from the tool handle thereby requiring additional storage space in the tool handle and increasing material cost. The LEATHERMAN MULTI-PURPOSE TOOL PSII® noted above attempted to locate the scissor pivot close to the multi-function tool axle. However, to accomplish this result, the second scissor blade includes two separate portions. This configuration increases material costs and requires additional storage space within the tool handle.

Another type of spring utilized with the second arrangement may be configured as a coil spring mounted about the blade pivot. This spring type is exemplified in U.S. Pat. No. 4,203,208 entitled "BIASED POCKET KNIFE SCISSORS" to Tausendfreundt et al. The coil spring disclosed in the '208 patent is located in a tear shaped pocket in a first blade member. The first end of the coil spring includes a leg extending into an aperture in the second blade. The second end of the coil spring includes a portion which extends tangentially away from the arc of the coil spring and is biased against a side of the tear shaped pocket thereby biasing the blades to an open position.

This coil spring configuration does not, however, easily permit the blades to be located 180 degrees relative to one another for compact storage within the multi-function tool handle. Additionally, the coil spring is exposed and may therefore be contaminated by foreign particles. Further, the spring is compressed when the scissors are retracted in the tool handle. This may result in spring creep which can weaken the spring over time.

It is therefore desirable to provide a multi-function tool including spring biased scissors or other pivoted implement in which the scissors are configured to alleviate the short comings of prior art items discussed above. That is, in which the spring is not subject to damage or loss and does not require a separate fulcrum member, and where the blade pivot is located closer to the multi-function tool handle. Finally, it is also desirable to provide spring biased scissors having a spring that is not biased when the scissors are retracted in the tool handle.

SUMMARY OF THE PRESENT INVENTION

A spring-biased implement for use in a multi-function tool in accordance with one aspect of the present invention comprises a tool handle including an axle attached thereto. A first member is rotatably attached to the axle, and a second member is pivotally attached to the first member at a pivot. A spring is rotatably attached to the axle. The spring includes a first end attached to the first member and a second free end which biases the second member away from the first member.

In another aspect of the invention, the second member includes a handle extending a set distance beyond the axle distal the pivot.

In yet another aspect of the invention, the tool handle includes a web and a pair of sides extending therefrom defining an internal channel. The first and second members may be located within the internal channel in a retracted position. The members may be rotated about the axle to an extended working position.

In still a further aspect of the invention the second free end of the spring is not biased by the first and second members when the first and second members are located within the internal channel.

Other principal features and advantages of the invention will become apparent to those skilled in the art upon review of the following drawings, the detailed description and the appended claims.

BRIEF DESCRIPTION OF THE DRAWINGS

The invention will hereafter be described with reference to the accompanying drawings, wherein like reference numerals denote like elements, and.

DETAILED DESCRIPTION OF A PREFERRED EXEMPLARY EMBODIMENT

Figure 1:
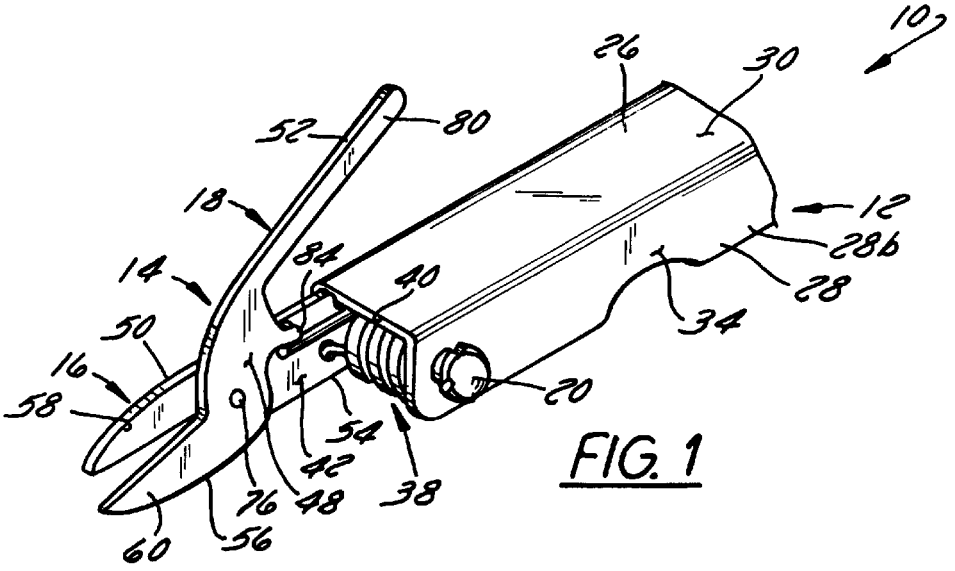
FIG. 1 is an isometric view of the multi-function tool having spring biased scissors in the extended position.

While the preferred embodiment will be described with reference to a pair of scissors, it is understood that the invention can be used with other pivoted implements such as pliers or the like. Referring to FIG. 1, we will now make a detailed description of an exemplary tool 10 in accordance with the present invention. Tool 10 includes a channel-shaped handle 12 and a pair of spring-biased scissors 14 having a first member and a second or working member 18 pivotally attached thereto. Tool 10 may also include a second handle (not shown) which may be connected to the first handle. However, for the purpose of describing the instant invention, the description of one handle is sufficient.

In contrast to the LEATHERMAN MULTI-PURPOSE TOOL PSII® described above in which the working member includes two components pivotally attached to one another, working member 18 of the preferred embodiment is a single component. First member 16, which is pivotally attached to handle 12 about an axle 20, is fixed relative to handle 12 when scissors 14 are in the extended position. A spring wire 22 biases working member 18 to an open cutting position relative to first member 16. As will be described below spring 22 is rotatably attached to axle 20 by means of a washer 24.

Figure 2:
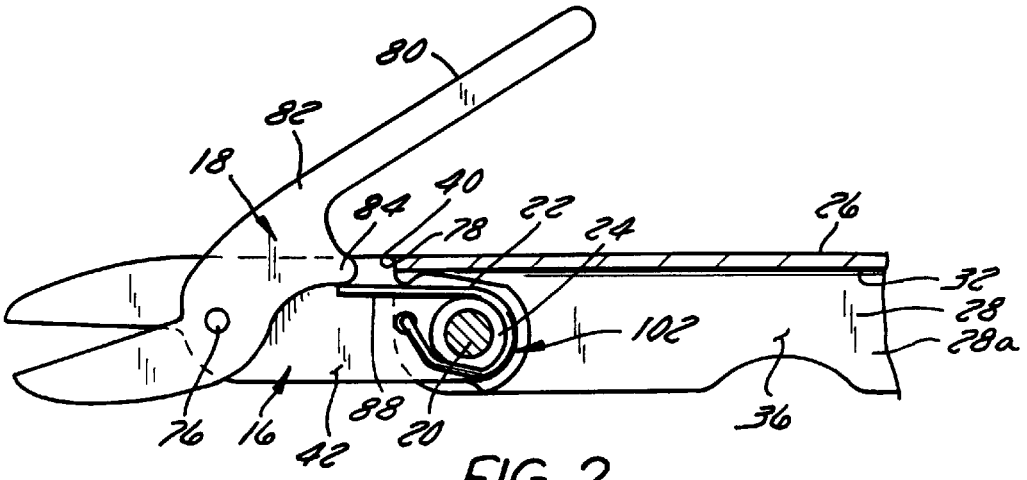
FIG. 2 is a cross-sectional view of the present invention with the blades in the open position.
Figure 3:
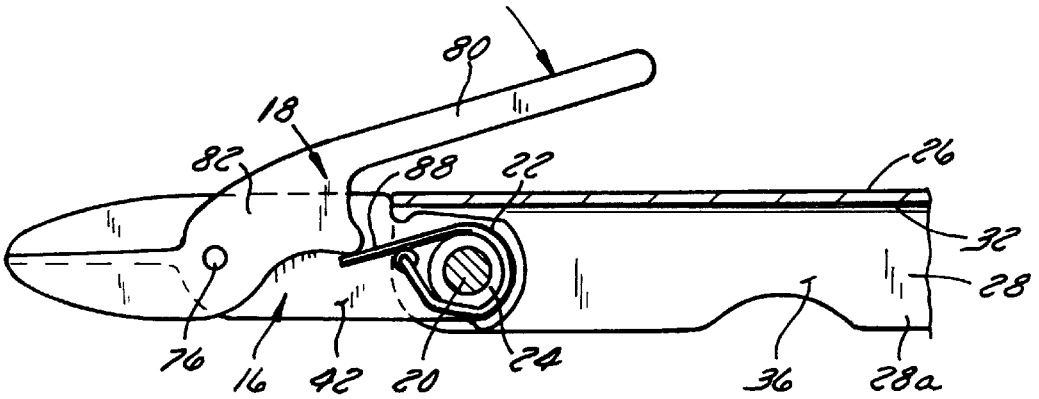
FIG. 3 is a cross-sectional view of the present invention with the blades in the closed position.
Figure 4:
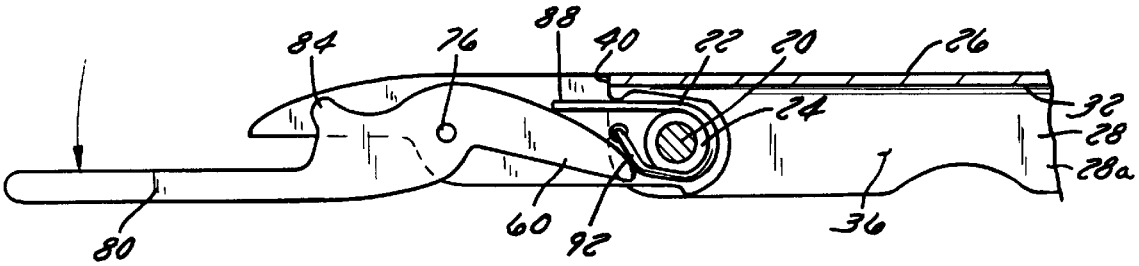
FIG. 4 is a cross-sectional view of the present invention with one of the members rotated 180 degrees from the closed position.
Figure 5:
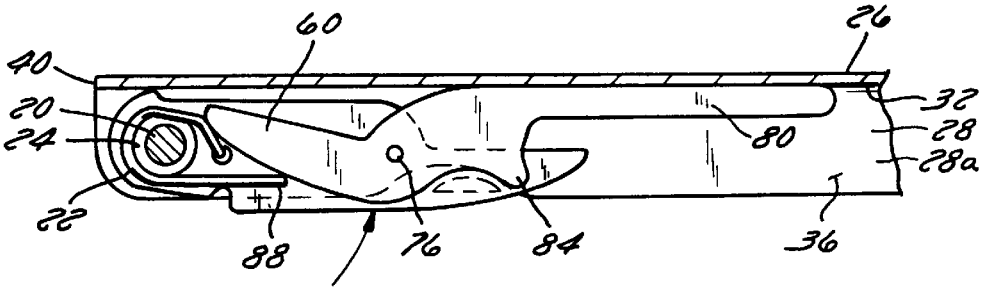
FIG. 5 is a cross-sectional view of the present invention with the spring biased scissors in the retracted position within the handle.

Referring to FIGS. 1–3, scissors 14 are in an extended position to perform the required cutting operation. As illustrated in FIGS. 4 and 5 scissors 14 are configured to rotate about axle 20 to a retracted or stored position within handle 12. Each of the components identified above will first be described in greater detail. The operation of scissors 14 and the rotation of scissors 14 from the extended to retracted positions will be subsequently described.

Referring to FIGS. 1–3 and 6, handle 12 includes a web 26 and a pair of sides 28 extending therefrom. Web 26 includes a top surface 30 and an oppositely facing bottom surface 32. Sides 28 include a first side 28a and a second side 28*b*. Each side 28 has an outer surface 34 and an inner surface 36. A channel 38 is formed between the inner surfaces 36 of sides 28 and the bottom surface 32 of web 26. Web 26 and sides 28 terminate along a handle edge 40 of handle 12. Axle 20 extends transversely across channel 38 between sides 28 proximate handle edge 40. Axle 20 is configured to receive a plurality of implements pivotally attached thereto.

Figure 6:
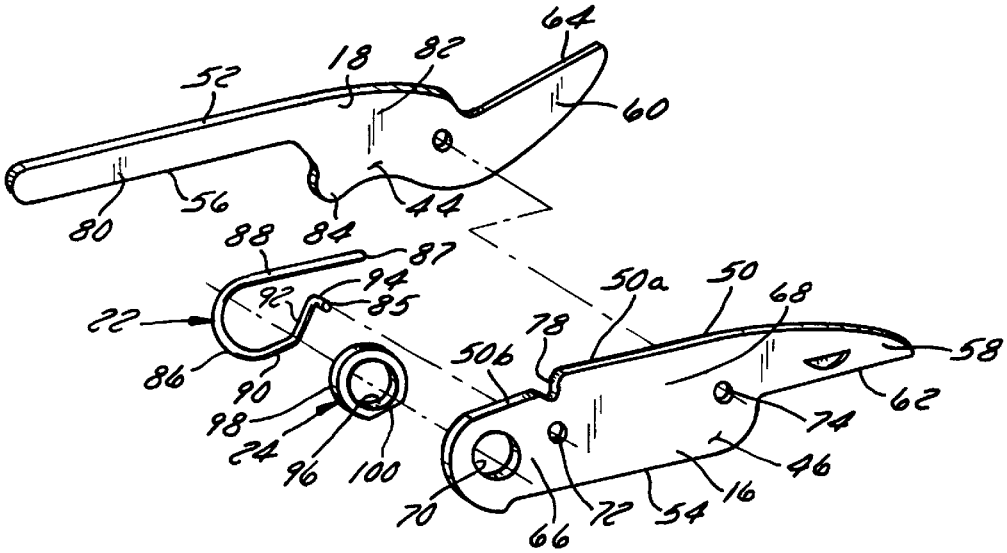
FIG. 6 is an exploded view of the members, washer and spring of the present invention.

Referring to FIGS. 1 and 6, scissors 14 will now be described. Each member 16, 18 includes respectively an inner or first surface 42, 44; an opposed outer or second surface 46, 48; a top edge 50, 52; and a bottom edge 54, 56. Each member 16, 18 further includes a blade 58, 60. Bottom edge 54 of first member 16 includes a cutting surface 62 proximate blade 58. Similarly, top edge 52 of working member 18 includes a cutting surface 64 proximate blade 60.

First member 16 further includes a tang 66 and a center portion 68 intermediate tang 66 and blade 58. Tang 66 includes a first aperture 70. A portion of axle 20 extends through first aperture 70. Tang 66 further includes a second aperture 72 located a set distance from first aperture 70 toward blade 58. As will be described below, an end of spring 22 is located within second aperture 72. Center portion 68 includes a third aperture 74 located intermediate the tang 66 and blade 58. A pivot 76 extends through third aperture 74 configured to permit rotation of working member 18 relative to first member 16.

Top edge 50 of first member 16 includes a step having an edge 78 extending transverse to a first region 50*a* and a second region 50*b* of top edge 50. As illustrated in FIG. 2, edge portion 78 is in contact with handle edge 40 of tool handle 12 when scissors 14 are in an extended position.

Working member 18 of scissors 14 further includes a handle 80 and a center portion 82 intermediate handle 80 and blade 60. Center portion 82 includes a protrusion or projection 84 extending from bottom edge 56 by a set distance. In the preferred embodiment projection 84 has a curvilinear contour, however, other forms may be utilized as well. Projection 84 is in contact with spring 22 to bias members 16, 18 to the open position. The curvilinear contour of projection 84 ensures continuous contact with spring 22 permitting smooth operation of the scissors.

Referring to FIGS. 2 and 6, spring 22 is a spring wire having a first or fixed end 85 and a second or free end 87. Spring 22 further includes an arcuate portion 86 intermediate the fixed and free ends 85, 87 and an arm 88 extending tangentially from arcuate portion 86 to the second free end 87. Spring 22 further includes a flat region 90 extending from arcuate portion 86. A stop portion 92 extends from flat region 90 at an angle for a set distance. Finally, spring 22 includes a leg 94 extending from the stop portion 92 transverse to the plane of the spring.

As illustrated in FIG. 6, washer 24 includes an arcuate inner surface 96 and an arcuate outer surface 98 having a flat 100. Inner surface 96 of washer 24 is sized to permit a portion of axle 20 to extend through washer 24. Outer arcuate surface 98 and flat 100 are sized to cooperate with arcuate portion 86 and flat region 90 of spring 22. Arcuate portion 86 of spring 22 is configured to receive arcuate surface 98 of washer 24. The outer dimensions of washer 24 are slightly greater than those spring 22 in its relaxed state to ensure positive engagement of spring 22 and washer 24. Washer 24 is rotatably attached to axle 20. In this manner spring 22 and washer 24 form an assembly 102 which rotates about axle 20 together.

The assembly of tool 10 with scissors 14 in the extended position will now be described. In the preferred embodiment first member 16 of scissor 14 is rotatably attached to axle 20 such that outer surface 46 of first member 16 is adjacent inner surface 36 of side wall 28*a*. Spring 22 and washer 24 are rotatably attached to axle 20 adjacent inner surface 42 of first member 16. In this orientation arm 88 of spring 22 extends along inner surface 42 of first member 16. Leg 94 of spring 22 extends transverse to the plane of spring 22 and is received within second aperture 72 of first member 16.

The engagement of leg 94 of spring 22 with first member 16 prohibits independent rotation of the spring and washer assembly 102. When arm 88 is deflected the spring and washer assembly 102 is fixed relative to first member 16. In this manner first member 16 and the spring and washer assembly 102 rotate together about axle 20.

As noted above working member 18 is pivotally attached to first member 16 at pivot 76. In the preferred embodiment, inner surface 44 of working member 18 is adjacent inner surface 42 of first member 16. When scissors 14 are in the extended position, projection 84 of working member 18 rests against a portion of the top surface of arm 88 of spring 22.

Handle 80 of working member 18 extends above and beyond handle edge 40 a set distance. This permits a user to depress handle 80 with one's thumb while holding on to tool handle 12 with the rest of one's hand. Depression of handle 80 toward web 26 results in the deflection of arm 88 of spring 22 thereby enabling the blades 58, 60 to move toward one another to cut an object. (See FIG. 3). Upon release of handle 80 arm 88 biases projection 84 back to the open position. It is important to note that spring 22 is only biased when handle 80 is depressed during the cutting action.

The rotation of scissors 14 to the retracted position within tool handle 12 will now be described. As illustrated in FIG. 4 handle 80 of working member 18 is rotated about pivot 76 until bottom edge 56 of blade 60 is in contact with stop portion 92 of spring 22. In this orientation of the first and second members 16, 18, working member 18 is substantially 180 degrees relative to first member 16. (See FIG. 4).

Once working member 18 engages spring 22, continued force applied to handle 80 of working member 18 causes the rotation of first member 16 about axle 20. Of course, if scissors 14 are positively locked relative to handle 12, they must be unlocked to permit rotation of the first member 16 about axle 20. In this manner scissors 14 are rotated within channel 38 of tool handle 12 until handle 80 of working member 18 comes in to contact with the bottom surface 32 of web 26. (See FIG. 5). In this retracted position, scissors 14 are substantially located within channel 38.

In the retracted position spring 22 is not biased. Specifically, projection 84 of working member 18 is not in contact with arm 88 of spring 22 when the scissors are in the retracted position. As noted above spring 22 is only biased when handle 80 is depressed during the cutting action.

Although the invention has been described in conjunction with specific embodiments thereof, it is evident that many alternatives, modifications and variations will be apparent to those skilled in the art. For example, spring 22 may have other configurations. It is possible to combine flat region 90 and stop portion 92 in a single continuous region that would act to both secure spring 22 to washer 24 as well as provide a stop for blade 60 when the scissors are being rotated from an extended to a retracted position.

Additionally, second free end 87 of spring 22 may contact working member 18 in a manner to bias the working member 18 away from first member 16.

Accordingly, the invention as described above and hereinafter claimed is intended to embrace all such alternatives, modifications and variations that fall within the spirit and broad scope of the appended claims:

What is claimed is:

1. A multi-function tool having a spring-biased implement comprising:

a tool handle and an axle extending through the tool handle;

a first member rotatably attached to the axle;

a second member pivotally attached to the first member a set distance from the axle at a pivot; and a spring rotatably attached to the axle, the spring having a first end attached to the first member and an arm biasing the second member away from the first member.

2. The multi-function tool of claim 1, wherein each member includes a jaw and associated handle.

3. The multi-function tool of claim 2, wherein the jaws are plier jaws.

4. The multi-function tool of claim 2, wherein the jaws are blades.

5. The multi-function tool of claim 1, wherein the spring includes an arcuate portion located intermediate the first end and the arm, the arm extending tangentially from the arcuate portion.

6. The multi-function tool of claim 5, further including a washer rotatably attached to the axle, the arcuate portion of the spring being configured to receive a portion of the washer.

7. The multi-function tool of claim 6, wherein the spring includes a flat region adjacent the arcuate portion and a stop portion adjacent the flat region.

8. The multi-function tool of claim 7, wherein the washer includes a flat configured to cooperate with the flat region of the spring.

9. The multi-function tool of claim 5, wherein the first member and the second member each include a blade, the second member including a handle distal the blade, the handle extending above the tool handle a set distance from the axle.

10. The multi-function tool of claim 9, wherein the second member can be pivoted about the pivot such that the second member is substantially 180 degrees with respect to the first member.

11. The multi-function tool of claim 10, wherein the blade of the second member includes a cutting edge and a back edge opposite thereto, the back edge engaging the stop portion of the spring when the second member is substantially 180 degrees with respect to the first member to facilitate rotation of the implement about the axle.

12. The multi-function tool of claim 11, wherein the tool handle includes a web and a pair of sides extending therefrom defining a channel, the first member being pivotally attached to the axle such that the first member and second member may be located within the channel of the tool handle with the second member substantially at 180 degrees with respect to the first member.

13. A multi-function tool having a spring-biased implement comprising:

a channel-shaped tool handle including a handle edge and an axle extending across a channel formed in the handle, the axle a set distance from the handle edge, the tool handle having a web and a pair of sides extending therefrom;

a pivoted implement having a first member rotatably attached to the axle, and a second member pivotally attached to the first member at a pivot, the implement being rotatable about the axle from an extended position to a retracted position within the channel; and a spring extending from the axle, the spring having a first end attached to the axle and a second end opposite the first end, wherein the second end biases the second member away from the first member when the implement is in the extended position.

14. The multi-function tool of claim 13, wherein the implement is a pair of scissors.

15. The multi-function tool of claim 13, wherein the implement is a pair of pliers.

16. The multi-function tool of claim 13, wherein the first member and the second member each include a blade, the second member including a handle distal the blade, the handle extending above the web a set distance from the axle.

17. The multi-function tool of claim 16, wherein the second member includes a projection intermediate the pivot and the handle, the second end of the spring engaging the projection when the first and second members are in the extended position.

18. The multi-function tool of claim 17, wherein the second member can be pivoted about the pivot such that the handle of the second member is adjacent the blade of the first member.

19. The multi-function tool of claim 18, wherein, the second member engages the spring when the handle of the second member is adjacent the blade of the first member.

20. The multi-function tool of claim 19, wherein the first member may be pivoted about the axle such that the first member and second member are located within the channel of the tool handle, the blade of the second member being adjacent the handle of the first member.

21. A multi-function tool having a pair of scissors comprising:

a tool handle including an axle attached thereto;

a first member rotatably attached to the axle;

a second member pivotally attached to the first member at a pivot lying a set distance from the axle; and a spring rotatably attached to the axle, the spring having a first end attached to the first member and an arm proximate a second end biasing the second member away from the first member.

22. The multi-function tool of claim 21, wherein the first member and the second members each include a blade, the second member including a handle distal the blade, the handle extending above the tool handle a set distance from the axle.

23. The multi-function tool of claim 22, wherein the tool handle includes a web and a pair of sides extending therefrom defining an internal channel, the first and second members being substantially located within the internal channel in a stored position, and being rotatable about the axle to an extended working position.

24. The multi-function tool of claim 23, wherein the arm of the spring does not bias the first and second members when the first and second members are located within the internal channel.

25. The multi-function tool of claim 24, wherein the blade of the second member includes a cutting edge and a back edge opposite thereto, the second member being pivotal about the pivot such that the back edge of the blade engages a portion of the spring.

* * * * *